US006520138B2

(12) United States Patent
Minegishi et al.

(10) Patent No.: US 6,520,138 B2
(45) Date of Patent: Feb. 18, 2003

(54) AIR INTAKE APPARATUS FOR INTERNAL COMBUSTION ENGINE

(75) Inventors: Teruhiko Minegishi, Hitachinaka (JP); Misturu Yamashita, Hitachinaka (JP); Hiroyuki Nemoto, Tokai-mura (JP); Akihiro Munakata, Hitachinaka (JP)

(73) Assignees: Hitachi, Ltd., Tokyo (JP); Hitachi Car Engineering Co., Ltd., Hitachinaka (JP)

( * ) Notice: Subject to any disclaimer, the term of this patent is extended or adjusted under 35 U.S.C. 154(b) by 0 days.

(21) Appl. No.: 09/749,475

(22) Filed: Dec. 28, 2000

(65) Prior Publication Data

US 2001/0000573 A1 May 3, 2001

Related U.S. Application Data

(63) Continuation of application No. 09/290,878, filed on Apr. 14, 1999.

(30) Foreign Application Priority Data

Apr. 14, 1998 (JP) ..... 10-103110

(51) Int. Cl.[7] ..... F01L 7/00

(52) U.S. Cl. ..... 123/190.5; 123/190.8; 123/184.56

(58) Field of Search ..... 123/190.5, 190.8, 123/184.56

(56) References Cited

U.S. PATENT DOCUMENTS 4,517,938 A * 5/1985 Kruger ..... 123/190.5
5,123,382 A * 6/1992 Aoki et al. ..... 123/184.36
5,315,969 A * 5/1994 MacMillan ..... 123/190.8
5,524,579 A * 6/1996 Eluchans ..... 123/190.8
5,555,865 A * 9/1996 Kim ..... 123/184.56
5,584,270 A * 12/1996 Dohring ..... 123/184.56
5,704,327 A * 1/1998 Dohring ..... 123/184.56
5,706,775 A * 1/1998 Schweter et al. ..... 123/190.5
5,823,157 A * 10/1998 Muramatsu ..... 123/184.56
5,875,758 A * 3/1999 Fujita ..... 123/336
5,901,677 A 5/1999 Ohrnberger et al.
5,941,206 A * 8/1999 Smith et al. ..... 123/190.8
6,125,820 A * 10/2000 Hiraoka ..... 123/336

FOREIGN PATENT DOCUMENTS

| | | |
|---|---|---|
| JP | 60-224924 | 9/1985 |
| JP | 6-81719 | 3/1994 |
| JP | 6-81735 | 3/1994 |
| JP | 8-170536 | 7/1996 |

* cited by examiner

*Primary Examiner*—Marguerite McMahon
*Assistant Examiner*—Jason Benton
(74) *Attorney, Agent, or Firm*—Crowell & Moring, LLP

(57) ABSTRACT

A rotating shaft and a drive shaft are used in an air intake apparatus for an internal combustion engine. At one end portion of the rotating shaft and the drive shaft a sphere portion and a projection portion are formed, and another end portion of the rotating shaft and the drive shaft a cup portion and a faucet portion are formed. The sphere portion is inserted to the cup portion and further the projection portion is engaged with the faucet portion, thereby a universal joint is formed. Since a connection structure between the rotating shaft and the drive shaft is constituted with few component elements, a cost reduction in the air intake apparatus for the internal combustion engine can be improved.

5 Claims, 3 Drawing Sheets

AIR INTAKE APPARATUS FOR INTERNAL COMBUSTION ENGINE

This application is a continuation of application Ser. No. 09/290,878, filed Apr. 14, 1999.

BACKGROUND OF THE INVENTION:

The present invention relates to an air intake apparatus for an internal combustion engine and in particular to an air intake apparatus for an internal combustion engine wherein a rotation force transmission structure to an opening and closing valve of an air intake apparatus.

As to techniques relating to the above stated technique, the techniques are described in Japanese application patent laid-open publication No. Sho 60-224924, Japanese application patent laid-open publication No. Hei 6-81719, Japanese application patent laid-open publication No. Hei 6-81735, and Japanese application patent laid-open publication No. Hei 8-170536, etc.

In a construction shown in FIG. 2 of Japanese application patent laid-open publication No. Sho 60-224924, by rotating a substantially cylindric shape surge tank since a position of an opening portion of an air intake conduit is varied and further since a length of the air intake conduit is varied, an output torque of an internal combustion engine can be heightened by utilizing an air intake inertia effect.

In a construction shown in FIG. 33 of Japanese application patent laid-open publication No. Hei 6-81719 or in a construction shown in FIG. 3 of Japanese application patent laid-open publication No. Hei 6-81735, an opening and closing valve is provided at a midway of an air intake conduit, when an internal combustion engine rotates at a low speed rotation, by closing the opening and closing valve a length of the air intake conduit is made long and then an output torque during the low speed rotation of the internal combustion engine is heightened.

In a construction shown in Japanese application patent laid-open publication No. Hei 8-170536, within two air intake conduits having respectively a different length, at an air intake passage of an intermediate portion of one air intake conduit having a short length a cylindrical shape shielding mechanism is provided. And in response to a rotation number of an internal combustion engine since the shielding mechanism is opened or closed, and further by employing only another air intake conduit having a long length or by employing the above stated both two air intake conduits, an increase in a flow passage cross-sectional area is selected, as a result an output torque of the internal combustion engine is heightened.

In each of the above stated prior arts, to aim to heighten the output torque utilizing the inertia effect of the intake air in the internal combustion engine, the length of the air intake conduit or the flow passage cross-sectional area is varied. And to vary the length of the air intake conduit or to vary the flow passage cross-section area, a butterfly shape valve or a cylindrical shape opening and closing valve is used.

The butterfly shape valve comprises a flat plate shape valve main body and a rotating shaft and the valve main body and the rotating shaft are manufactured separately or independently and this valve main body and this rotating shaft are combined with screw members etc. The rotating shaft has a long and slender rod shape, to this rotating shaft plural butterfly shape valves are installed. To prevent an obstruction of a rotation sliding operation due to a bending deformation of the rotating shaft, not only bearing member is provided to both ends of the rotating shaft but also a bearing member is provided between the butterfly shape valve and the another butterfly shape valve.

To install the above stated construction having the valve main body and the bearing members to a midway of the air intake conduit of an air intake apparatus for the internal combustion engine, since the air intake conduit is necessary to form with two-divisional construction or two separated constitution there is an afraid of a lowering of a dimension accuracy in the air intake apparatus on an assembly performance.

On the other hand, in the cylindrical shape opening and closing valve in the air intake apparatus for the internal combustion engine, an opening portion which penetrates to a radial direction of a cylinder is provided on the cylindrical shape opening and closing valve, a valve portion is constituted by the opening portion and another portion except for the opening portion. By rotating this opening portion, the intake air which passes through the opening portion is discontinued.

With the above stated mechanism, a whole peripheral portion of the cylinder of the internal combustion engine becomes a rotating shaft, a bending deformation of the rotating shaft in the cylindrical shape opening and closing valve is smaller than that of the rotating shaft of the butterfly shape valve, further since a shaft portion and the valve portion are manufactured integrally, there is a merit in which the manufacturing is easily.

Further, by employing an assembling method in which a hole portion for inserting the cylindrical shape opening and closing valve is manufactured integrally to an axial direction at a part of the air intake conduit of the air intake apparatus for the internal combustion engine and the cylindrical shape opening and closing valve is inserted to this hole portion, it is unnecessary to divide two parts the air intake conduit as the case of the butterfly shape valve, accordingly a lowering in a dimension accuracy of the air intake apparatus for the internal combustion engine in a radial direction which is accompanied by the assembling working can be avoided.

In a construction of the air intake apparatus for the internal combustion engine shown in Japanese application patent laid-open publication No. Hei 8-170536, one end of a cylindrical shape opening and closing valve is contacted to a small hole portion which is provided at a bottom of a hole portion and also using a spring member the cylindrical shape opening and closing valve is added with an axial direction force to come off from this small hole portion of the cylindrical shape opening and closing valve.

However, in the above stated prior arts, there is no consideration about a relationship between a direction of the rotating shaft of the connection member for connecting the rotating mechanism for rotating the cylindrical shape opening and closing valve and the cylindrical shape opening and closing shaft and a direction of the rotating shaft of the cylindrical shape opening and closing valve. As a result, between the above stated directions since a divergence, namely an inclination exists, there is a possibility in which the rotation becomes to present non-smoothly.

The inventors of the present invention have filed a prior patent application about an air intake apparatus for an internal combustion engine in which the problems not solved in the above stated prior arts can be solved, as a prior patent application (at the present patent filing time, the above stated prior patent application is not laid-opened and does not form the prior art against the present patent application). Namely, in the prior patent application, the connection member for the cylindrical shape opening and closing valve and the rotating mechanism is contacted to the cylindrical shape opening and closing valve through a ball like member.

Even the inclination (the divergence) exists between the direction of the rotating shaft of the connection member for connecting the rotating mechanism which rotates the cylindrical shape opening and closing valve and the cylindrical shape opening and closing valve and the direction of the rotating shaft of the cylindrical shape opening and closing valve, since the ball like member works as one kind of a ball joint mechanism, the rotation can be transmitted smoothly.

SUMMARY OF THE INVENTION

An object of the present invention resides in that, the problems which have not been solved in the prior arts can be solved, namely when an inclination exists between an axial direction of a rotating shaft for rotating a cylindrical shape opening and closing valve and an axial direction of a drive shaft a rotating motion can be transmitted smoothly, and the object of the present invention to provide an air intake apparatus for an internal combustion engine wherein a simple construction, an easy manufacturing, a low cost air intake apparatus for the internal combustion engine can be provided.

Further, another object of the present invention is to provide an air intake apparatus for an internal combustion engine wherein a durability in the air intake apparatus can be heightened by carrying out a position regulation against to a thrust direction of a drive shaft.

A sphere portion which is provided at a tip end portion of a shaft portion of one of the rotating shaft and the drive shaft or an input shaft (in this application, it is called as the drive shaft) is inserted to a cup member which is provided at a tip end portion of another shaft of one of the rotating shaft and the drive shaft, and a projection portion of one of the rotating shaft and the drive shaft is engaged with a faucet portion which is provided at the tip end portion of the another shaft of the rotating shaft and the drive shaft and then a universal joint is constituted. According to these constructions, a welding working and a shaving-off working can be became unnecessary.

Further, a position regulation of a thrust direction of the drive shaft is attained that the drive shaft and a ball bearing member are inserted under pressure and fixed, and after the ball bearing member has inserted to a resin housing, in accordance with a stopping operation due to a spring force by a stopper ring and a bite-in of the stopper ring to the resin housing, then the ball bearing member is fixed to the resin housing. According to this construction, by the stopper ring having the spring operation the ball bearing member can be fixed to the resin housing.

In concretely, the present invention can provide following air intake apparatus apparatuses for the internal combustion engine.

The present invention can provide that an air intake apparatus for an internal combustion engine comprises an opening and closing valve for shielding the air intake supplied to an internal combustion engine, a rotating shaft installed to the opening and closing valve as one body, a drive shaft for rotating the rotating shaft, a connection portion for connecting the rotating shaft and the drive shaft and for transmitting a move from the drive shaft to the rotating shaft.

The air intake apparatus for the internal combustion eigne wherein on an end portion of one of the rotating shaft and the drive shaft, a sphere portion and a projection portion are formed, on another end portion of one of the rotating shaft and the drive shaft, a cup portion and a faucet portion are formed, and the sphere portion is inserted into the cup portion and further the projection portion is engaged with the faucet portion, thereby a universal joint is formed. Preferably, an inner portion of the above stated faucet portion is formed with a dent shape, and further an outer portion of the above stated projection portion is formed with a raise portion.

Preferably, the above stated drive shaft is provided in the resin housing, and to the above stated drive shaft a ball bearing member is fixed, and to the resin housing a part of the ball bearing member is stopped, and further the ball bearing member is fixed to the above stated resin housing by a stopper ring having a spring operation.

The present invention provides an air intake apparatus for an internal combustion engine in which the above stated drive shaft is provided in the resin housing, a shaft portion of the above stated opening and closing valve and the above stated drive shaft are connected with a universal joint construction, to the above stated drive shaft a ball bearing member is fixed, and to the above stated resin housing a part of the ball bearing member is stopped, and further the above stated ball bearing member is fixed to the above stated resin housing by a stopper ring having a spring operation.

DESCRIPTION OF THE INVENTION

Hereinafter, an air intake apparatus for an internal combustion eigne of one embodiment (a first embodiment) according to the present invention will be explained referring to figures.

In an air intake apparatus for an internal combustion eigne of one embodiment (the first embodiment) according to the present invention, an air intake apparatus for a spark ignition system internal combustion engine which uses the fuel such as the gasoline is exemplified, however the present invention can be applied to the air intake apparatuses for other internal combustion engines such a self ignition system internal combustion engine, etc.

Figure 1:
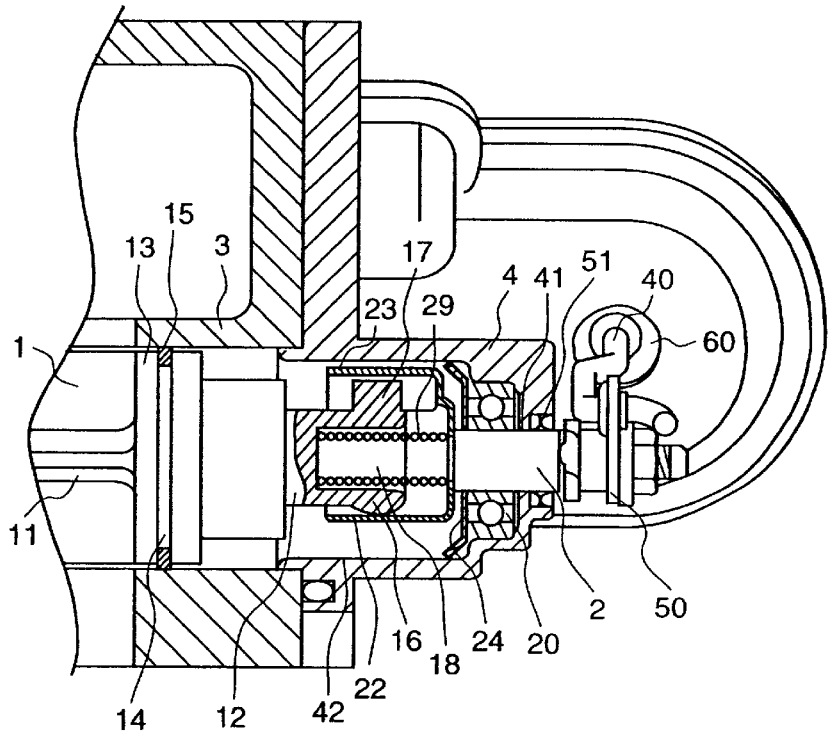
FIG. 1 is a cross-sectional view showing an air intake apparatus for an internal combustion eigne of one embodiment (a first embodiment) according to the present invention.
Figure 2:
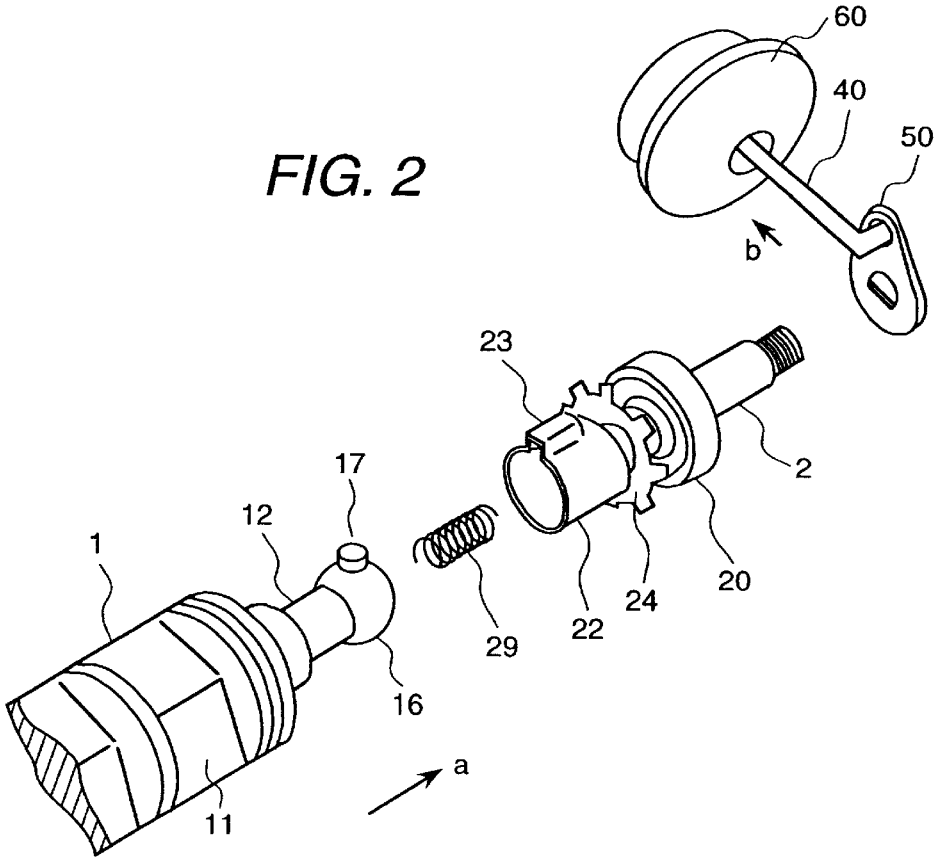
FIG. 2 is a perspective view showing a construction summary of an air intake apparatus for an internal combustion eigne of one embodiment (the first embodiment) according to the present invention.

A summary of a construction of an air intake apparatus for an internal combustion engine of one embodiment (the first embodiment) according to the present invention will be explained referring to FIG. 1 and FIG. 2. FIG. 1 shows a detailed cross-sectional view showing an air intake apparatus for an internal combustion engine of one embodiment (the first embodiment) which guides the air intake for supplying to the internal combustion engine (not shown in figure), and FIG. 2 shows a perspective view of a component construction of the air intake apparatus for the internal combustion engine shown in FIG. 1.

The air intake apparatus for the internal combustion engine comprises mainly an air intake conduit and the air intake conduit for guiding the air intake which is inhaled to the internal combustion engine. An injector is installed to the air intake conduit and the injector supplies the fuel to a combustion chamber of a respective cylinder of the internal combustion engine. A fuel conduit is installed to the injector and the fuel is supplied to the combustion chamber of the internal combustion engine.

The above stated air intake conduit of the internal combustion engine comprises a collector comprised of one chamber, branches having same number air intake passages to a number of cylinders of the internal combustion engine, a flange for combining with a throttle valve opening and closing valve which adjusts an amount of the air intake, and another flange for combining an internal combustion engine block and those above stated elements are manufactured integrally.

A construction of an opening and closing valve 1 of the air intake apparatus for the internal combustion engine will be explained referring to FIG. 1 and FIG. 2.

An essential construction of the opening and closing valve 1 in the air intake apparatus for the internal combustion engine have a valve body portion 11, a rotating shaft 12, and a valve holder 3. The valve body portion 11 has a flat plate shape and further the rotating shaft 12 has a round rod shape. Since each of the valve body portion 11 and the rotating shaft 12 has a simple shape, the valve body portion 11 and the rotating shaft 12 can be manufactured integrally and easily.

For example, each of the materials for the valve body portion 11 and the rotating shaft 12 of the air intake apparatus can employ a synthetic resin and are can be made according to an integral transformation process or can be manufactured according to an integral casting process or a forging process using a light alloy metal such as an aluminum alloy metal. Further, of course the valve body portion 11 and the rotating shaft 12 can be formed respectively using a separate material or an individual material.

To the rotating shaft 12 a pair of sealing portions 13 are formed to a peripheral direction with a respective above stated air intake branches 13 and to a groove 14 which is formed at an intermediate portion of the pair of sealing portions 13 a sealing ring 15 is fitted into. This sealing ring 15 is fitted into rotatively against a rotation direction of the valve body portion 11 of the opening and closing valve 1. A material for the sealing ring 15 is established by taking into the consideration of a sliding performance. The sealing ring 15 works a role of a sealing operation of the intake air together with an inner face of the valve holder 3.

A sphere shape portion 16 is formed at a tip end portion of the rotating shaft 12 and further a projection portion 17 is formed integrally. The projection portion 17 has a shape to which a part of the sphere shape portion 16 is projected. A hole portion 18 is formed to a center portion of a shaft portion to which the sphere shape portion 16 is provided and to this hole portion 18 a spring member 29 as stated in a latter is inserted.

Figure 3:
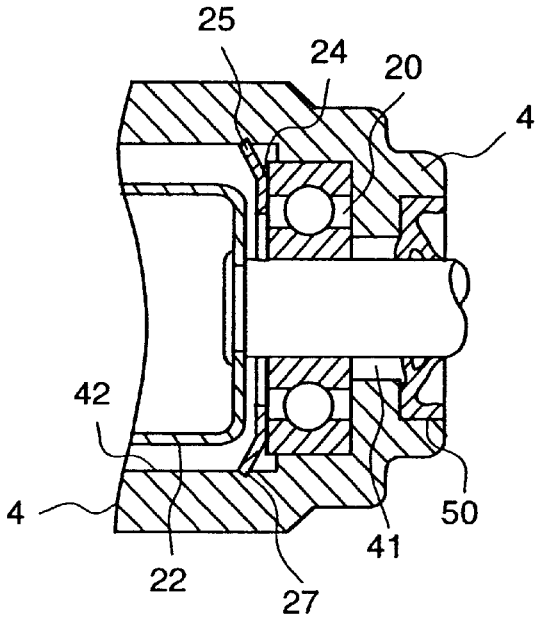
FIG. 3 is a detailed view showing a part of the air intake apparatus for the internal combustion eigne of one embodiment according to the present invention shown in FIG. 1.
Figure 4:
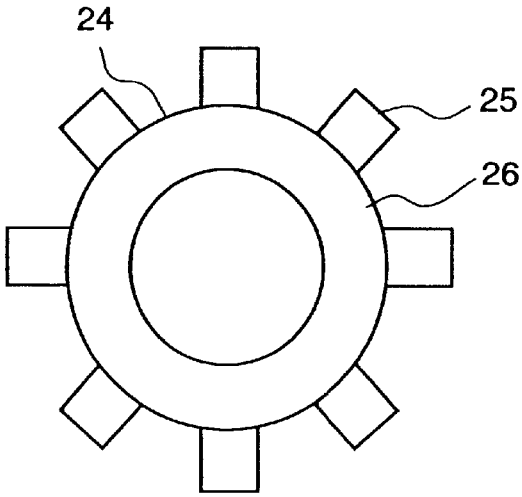
FIG. 4 is a detailed view showing one component (a stopper ring) of the air intake apparatus for the internal combustion eigne of one embodiment according to the present invention shown in FIG. 3.

The valve holder 3 is formed with a resin housing 4 as one body. A drive shaft 2 is provided in a drive shaft use hole portion 41 which is arranged to the resin housing As stated in the above according to the first embodiment of the present invention, a ball bearing member 20 is inserted under pressure and fixed to the drive shaft 2 and to the resin housing 4 the ball bearing member 20 is inserted and fixed. A stopper ring 24 is provided at a left end side of the ball bearing member 20. This stopper ring 24, as shown in FIG. 4, is comprised of a thin single plate 26 which is manufactured by a punching-out process, and at a periphery portion of the stopper ring 24 plural projection portions 25 having a gear shape are formed and this projection portion 25 has a spring operation. This stopper ring 24 is arranged as shown in FIG. 3.

When this stopper ring 24 is inserted into a hole portion 42 which is formed at an interior portion of the resin housing 4, the reaction force generates and by this reaction force the projection member 25 is bitten into an inner face of the resin housing 4 and is stopped. Then the ball bearing member 20 is pressed against to the resin housing 4 and according to this operation a thrust direction position regulation of the drive shaft 2 is carried out and also the drive shaft 2 can be rotated. A reference numeral 27 shown in FIG. 3 indicates a bite-in portion.

As stated in the above, at one end of the drive shaft 2 the ball bearing member 20 is inserted under pressure and fixed and another end of the drive shaft 2 is penetrated to a hole portion 26 which is provided on the stopper ring 24 and a cup member 22 is fixed to the drive shaft 2. The cup member 22 has a cup shape which is formed by an elastic processing using a pressing-out process and an inner diameter of the cup member 22 has substantially to an outer diameter of the above stated sphere shape portion 16. At a part of the cup member 22 a faucet portion, for example as shown in FIG. 2, a cup raise portion 23 is formed. An inner side of the cup raise portion 23 has a dent portion as shown in FIG. 2.

The opening and closing valve 1 is moved to a right portion, as shown in an arrow mark a of FIG. 2, and the sphere portion 16 which is provided at the tip end portion of the above stated rotating shaft 12 is fitted into the cup member 22 and further the projection portion 17 is fitted into an inner face dent portion of the cup raise portion 23. A spring member 29 is arranged between the inner face of the cup member 22 and an inner portion hole 18 of the rotating shaft 12 and the spring member 29 prevents a jolt to a longitudinal direction of the opening and closing valve 1. With the construction constituted in the above, a universal joint is formed.

As stated in the above in the air intake apparatus for the internal combustion engine, even the convergence causes to the axial direction of the rotating shaft 12 and the axial direction of the drive shaft 2, according to the universal joint operation a rotation torque of the drive shaft 2 can be transmitted to the rotating shaft 12 without the obstacle. In accordance with the faucet between the cup raise portion 23 and the projection portion 17, since the rotation torque transmission can be carried out, and since the fixing between the drive shaft 2 and the cup member 22 can be carried out according to the fitting-into, the construction can be made simply and the component number can be made few, as a result the cost reduction of the air intake apparatus for the internal combustion engine can be attained.

Of course, the fixing manner between the drive shaft 2 and the cup member 22 can be fixed using screw members, and further the fixing can be fixed using an adhesion process, a pressure-in process and a welding method etc.

A rotation input from an actuator 60 is transmitted to the drive shaft 2. The actuator 60 is comprised of an actuator 60 output rod 40, a cover member, a spring member, a diaphragm member, one diaphragm member receiver, and another diaphragm member receiver, etc. (not shown in figure). The actuator output rod 40 is made to move an input lever 50.

When the negative pressure is supplied to a negative pressure chamber of the actuator 60, the diaphragm member is moved, as a result the actuator 60 output rod 40 is moved to an arrow mark b direction and the input lever 15 is moved and then the drive shaft 2 is rotated. A reference numeral 51 indicates an air-tight sealing use lip sealing.

The input lever 50 has a function in which the rotation of the drive shaft 2 is stopped with a beforehand predetermined angle.

Figure 5:
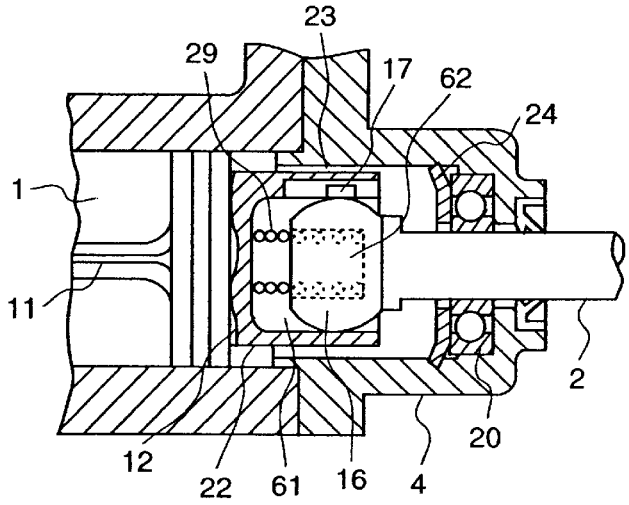
FIG. 5 is a cross-sectional view showing an air intake apparatus for an internal combustion eigne of another embodiment (a second embodiment) according to the present invention.

FIG. 5 shows another universal joint for constituting a connection portion between the rotating shaft 12 and the drive shaft 2 of a second embodiment according to the present invention.

In the air intake apparatus for the internal combustion engine of the above stated first embodiment according to the present invention, the sphere shape portion 16 and the projection portion 17 are formed to the rotating shaft 12 and the cup member 22 and the cup raise portion 23 are formed to the drive shaft 2. However, in the air intake apparatus for the internal combustion engine of this embodiment (the second embodiment) according to the present invention, reversely that of the first embodiment according to the present invention, the sphere shape portion 16 and the projection portion 17 can be formed to the drive shaft 2 and the cup member 22 and the cup raise portion 23 are formed to the rotating shaft 12.

In the air intake apparatus for the internal combustion engine of this second embodiment according to the present invention, the sphere shape portion 16 and the projection portion 17 are formed with the resin material and the sphere shape portion 16 and the projection portion 17 can be fixed to the drive shaft 2. The above stated sphere shape portion 16 is received in a hole portion 61 which is provided in an interior portion of the rotating shaft 12. Further, a spring member 29 is received in a hole portion 62 which is provided in an interior portion of the sphere shape portion 16 and then the pressure-in operation is generated between the rotating shaft 12 and the drive shaft 2.

With the above stated air intake apparatus construction in the second embodiment according to the present invention, similar to the air intake apparatus of the first embodiment according to the present invention the universal joint operation can be obtained. Further, the air intake apparatus construction having the same functions in the second embodiment according to the present invention are indicated using the same reference numerals in the first embodiment according to the present invention.

Figure 6:
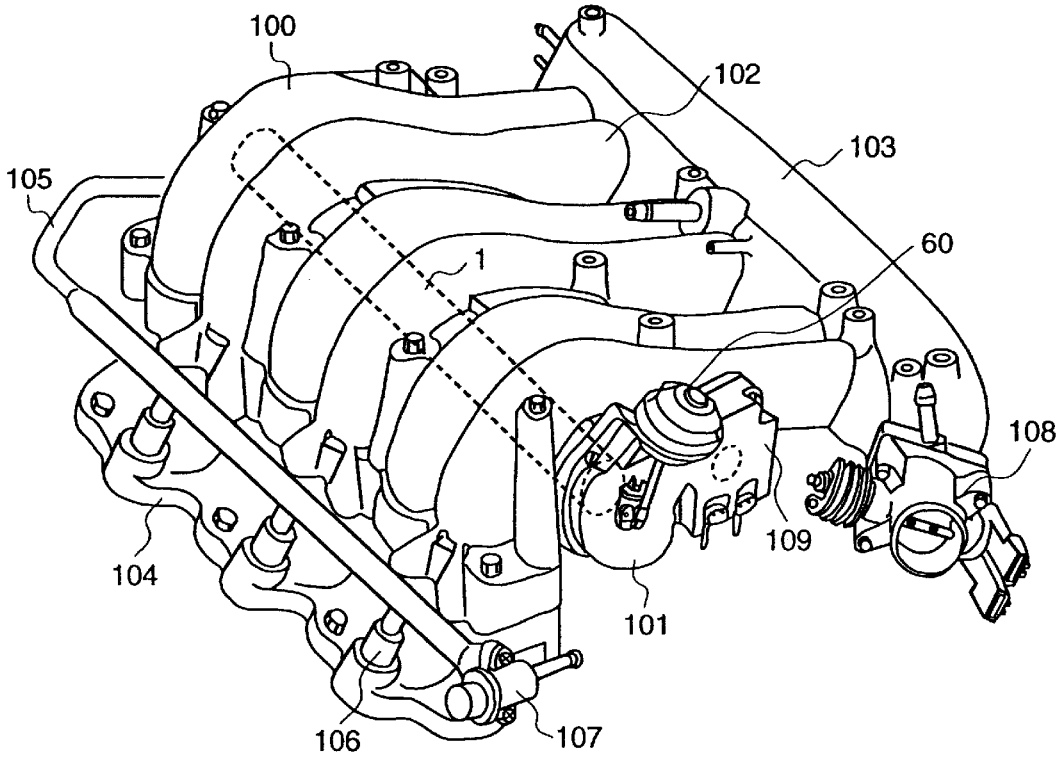
FIG. 6 is a perspective view showing an air intake apparatus construction for an internal combustion engine according to the present invention.

FIG. 6 is a perspective view showing an air intake apparatus construction for an internal combustion engine according to the present invention. In FIG. 6, an air intake apparatus construction 100 for an internal combustion engine comprises mainly a negative pressure module 101, four independent branching conduits 102, a collector 103, an air intake manifold 104, a fuel pipe 105, an injector 106, a fuel pressure regulator 107, a throttle valve chamber 108, and an actuator solenoid 109. To the negative pressure module 101, the opening and closing shaft 1, the actuator 60, and the actuator solenoid 109 are installed.

According to the present invention, in the connection construction between the rotating shaft and the drive shaft in the air intake apparatus for the internal combustion engine, since the combination construction between the sphere shape portion and the cup portion and the combination construction of the faucet construction between the projection portion and the cup raise portion are adopted, the universal operation can be displayed according to the simple construction and the easy manufacture construction. As a result, even the inclination exists between the axial direction of the rotating shaft and the axial direction of the drive shaft, the rotation transmission can be carried out smoothly with the low cost construction.

Further, according to the present invention, since the ball bearing member in the air intake apparatus for the internal combustion engine is pressed by the stopper ring having the spring operation, the thrust direction regulation of the drive shaft can be attained by the simple construction, and the cost reduction of the air intake apparatus for the internal combustion engine can be obtained by the simple construction.

What is claimed is:

1. An air intake apparatus for an internal combustion engine, comprising:

an air intake manifold;

a collector;

plural independent branching conduits for connection between said air intake manifold and said collector; and a pair of multiple system opening and closing valves provided across said plural independent branching conduits, wherein at one end of said pair of multiple system opening and closing valves, an actuator for driving said opening and closing valve is operatively mounted, and a throttle valve chamber for controlling an amount of air which is supplied to said collector is operatively mounted at said collector on the same side as said actuator.

2. An air intake apparatus according to claim 1, wherein said air intake manifold, said collector and said pair of multiple system opening and closing valves are arranged parallel to each other.

3. An air intake apparatus according to claim 1, wherein injectors are operatively mounted on said air intake manifold.

4. An air intake apparatus according to claim 3, wherein a fuel pipe for supplying fuel to said injectors is operatively mounted parallel to said air intake manifold, said collector, and said pair of multiple system opening and closing valves.

5. An air intake apparatus according to claim 4, wherein a pressure regulator for adjusting fuel pressure in said fuel pipe is operatively mounted at said fuel pipe an the same side as said throttle valve chamber and said actuator.

* * * * *